US011445757B2

(12) United States Patent
Ouyang

(10) Patent No.: US 11,445,757 B2
(45) Date of Patent: Sep. 20, 2022

(54) HEATING ELEMENT, ATOMIZER, AND ELECTRONIC CIGARETTE HAVING SAME

(71) Applicant: HONG KONG IVPS INTERNATIONAL LIMITED, Central (HK)

(72) Inventor: Junwei Ouyang, Shenzhen (CN)

(73) Assignee: HONG KONG IVPS INTERNATIONAL LIMITED, Central (HK)

( * ) Notice: Subject to any disclaimer, the term of this patent is extended or adjusted under 35 U.S.C. 154(b) by 375 days.

(21) Appl. No.: 16/738,064

(22) Filed: Jan. 9, 2020

(65) Prior Publication Data

US 2020/0221774 A1 Jul. 16, 2020

(30) Foreign Application Priority Data

Jan. 14, 2019 (CN) ..... 201920054067.1

(51) Int. Cl.
*A24F 40/46* (2020.01)
*A24F 40/10* (2020.01)
*A24F 40/44* (2020.01)

(52) U.S. Cl.
CPC ..... *A24F 40/46* (2020.01); *A24F 40/10* (2020.01); *A24F 40/44* (2020.01)

(58) Field of Classification Search
None
See application file for complete search history.

(56) References Cited

U.S. PATENT DOCUMENTS

2014/0060554 A1* 3/2014 Collett ..... A24F 40/46 392/386
2017/0196273 A1* 7/2017 Qiu ..... A24F 40/44
2018/0049466 A1* 2/2018 Cyphert ..... A24F 7/04
2019/0045834 A1* 2/2019 Fuisz ..... A24B 15/24
2020/0221774 A1* 7/2020 Ouyang ..... A24F 40/46

FOREIGN PATENT DOCUMENTS

CN 108451046 A 8/2018

OTHER PUBLICATIONS

European Patent Office, Search Report and Search Opinion, European Application No. 20151699.4, 5 pages, dated May 19, 2020.

* cited by examiner

*Primary Examiner* — James Harvey
(74) *Attorney, Agent, or Firm* — Thompson Hine LLP

(57) ABSTRACT

The present disclosure provides a heating element for an atomizer of an electronic cigarette. The atomizer defines an atomizing chamber and a liquid storing chamber for e-liquid refilling. The atomizer includes a heating element, which includes a heater, a liquid absorbent, and a solid-state protective layer. The solid-state protective layer is placed between the liquid absorbent and heater such that the e-liquid in the solid-state protective layer will be melted and absorbed by the liquid absorbent when the heater heats the solid-state protective layer under current drive.

20 Claims, 3 Drawing Sheets

HEATING ELEMENT, ATOMIZER, AND ELECTRONIC CIGARETTE HAVING SAME

CROSS-REFERENCE TO RELATED APPLICATION

This application claims priority to Chinese Patent Application No. 201920054067.1, filed on Jan. 14, 2019. The disclosure of the foregoing application is incorporated herein by reference in its entirety.

TECHNICAL FIELD

The present disclosure relates to the technical field of electronic cigarettes, and more particularly, a heating element, an atomizer having the same heating element, and an electronic cigarette having the same atomizer.

BACKGROUND

An electronic cigarette is also called an electronic cigarette, which is mainly used for smoking cessation and replacement of cigarettes. It has similar appearance and taste to traditional cigarettes but with even more flavors. Smoking electronic cigarettes may result in vapor that tastes and feels like traditional cigarette smoke. Because an electronic cigarette does not have the tobacco tar, smoke particles, and other toxic components of the traditional tobacco cigarettes, electronic cigarettes have gradually replaced traditional cigarettes and rapidly gained popularity by consumers.

Currently, the cartridge that holds the atomizer of an electronic cigarette commonly found on the market is often empty and un-filled by any e-liquid at the time of purchase by consumers. If a user accidentally heats the cartridge of an electronic cigarette before refilling the cartridge with any e-liquid or before the liquid absorbent of the atomizer is fully drenched in the liquid during his or her first use of the electronic product, the heating wire will dry burn and cause damages to liquid absorbent, which will prevent proper use of the electronic cigarette.

SUMMARY

In view of the above, the present disclosure aims to provide a heating element that can avoid dry burning during users' first use of the atomizer.

To achieve the purpose, the present disclosure provides a heating element using for an atomizer of an electronic cigarette. The atomizer defines an atomizing chamber and a liquid storing chamber for e-liquid refilling. The heating element includes a heater, a liquid absorbent and a solid-state protective layer.

When the heating element is installed in the atomizer, a part of the liquid absorbent is accommodated in the liquid storing chamber and the other part of the liquid absorbent is accommodated in the atomizing chamber so that the liquid absorbent can absorb the e-liquid refilled in the liquid storing chamber into the atomizing chamber.

At least part of the heating element is accommodated in the atomizing chamber and be in contact with the liquid absorbent.

The solid-state protective layer is placed between the liquid absorbent and the heater and will be melted and absorbed by the liquid absorbent when the heater heats the solid-state protective layer under current drive.

Preferably, the solid-state protective layer covers the surface of the heater.

Preferably, the heater includes a connector and an atomizing component contacting with the liquid absorbent. The connector electrically connects with the atomizer, and the atomizing component is used to heat the e-liquid absorbed by the liquid absorbent under current drive, with the solid-state protective layer covering at least the surface of the atomizing component.

Preferably, the atomizing component has a spiral shape, and winds on the surface of the liquid absorbent.

Preferably, the atomizing component is set as a hollow tube, and the solid-state protective layer is provided on an outer surface of the atomizing component. The liquid absorbent covers the surface of the solid-state protective layer. The hollow part of the heater defines an atomizing channel for smoke to pass through.

Preferably, the solid-state protective layer covers the surface of the liquid absorbent.

Preferably, the heater is made from one of nickel, titanium, tungsten, gold, silver, or stainless steel.

Preferably, the liquid absorbent is made from one of glass fiber thread, absorbent cotton, or organic cotton.

The present disclosure further provides an atomizer using for an electronic cigarette. The atomizer defines an atomizing chamber and a liquid storing chamber for e-liquid refilling. The atomizer further includes a heating element. The heating element includes a heater, a liquid absorbent and a solid-state protective layer. When the heating element is installed in the atomizer, a part of the liquid absorbent is accommodated in the liquid storing chamber and the other part of the liquid absorbent is accommodated in the atomizing chamber so that the liquid absorbent can absorb the e-liquid refilled in the liquid storing chamber into the atomizing chamber. At least part of the heater is accommodated in the atomizing chamber and be in contact with the liquid absorbent. The solid-state protective layer is placed in between the liquid absorbent and heater and will be melted and absorbed by the liquid absorbent when the heater heats the solid-state protective layer under current drive.

The present disclosure also provides an electronic cigarette. The electronic cigarette includes an atomizer. The atomizer defines an atomizing chamber and a liquid storing chamber for e-liquid refilling. The atomizer further includes a heating element. The heating element includes a heater, a liquid absorbent and a solid-state protective layer. When the heating element is installed in the atomizer, a part of the liquid absorbent is accommodated in the liquid storing chamber and the other part of the liquid absorbent is accommodated in the atomizing chamber so that the liquid absorbent can absorb the e-liquid refilled in the liquid storing chamber into the atomizing chamber. At least part of the heater of the heating element is accommodated in the atomizing chamber and be in contact with the liquid absorbent. The solid-state protective layer is placed between the liquid absorbent and the heater and will be melted and absorbed by the liquid absorbent when the heater heats the solid-state protective layer under current drive.

The present disclosure provides a heating element that places a solid-state protective layer between the heater and the liquid absorbent. The solid-state protective layer will be melted and absorbed by the liquid absorbent when the heater heats under current drive. The liquid absorbent will then contact with the heater for vaporization. This thus effectively prevent the dry burning of liquid absorbent by the heater when the atomizer is not refilled with e-liquid during the first use.

BRIEF DESCRIPTION OF THE DRAWINGS

For a better understanding of the technical scheme of the embodiment of the present disclosure or in the prior art, the following paragraphs briefly illustrate the drawings necessary in the description of the embodiment or in the prior art. Apparently, the following drawings are mere some embodiment of the present disclosure. For the ordinary skilled persons in this field, one may obtain other drawings without any creative work based on the structure of the following drawings.

DESCRIPTION OF REFERENCE NUMBERS IN THE DRAWINGS

Figure 1:
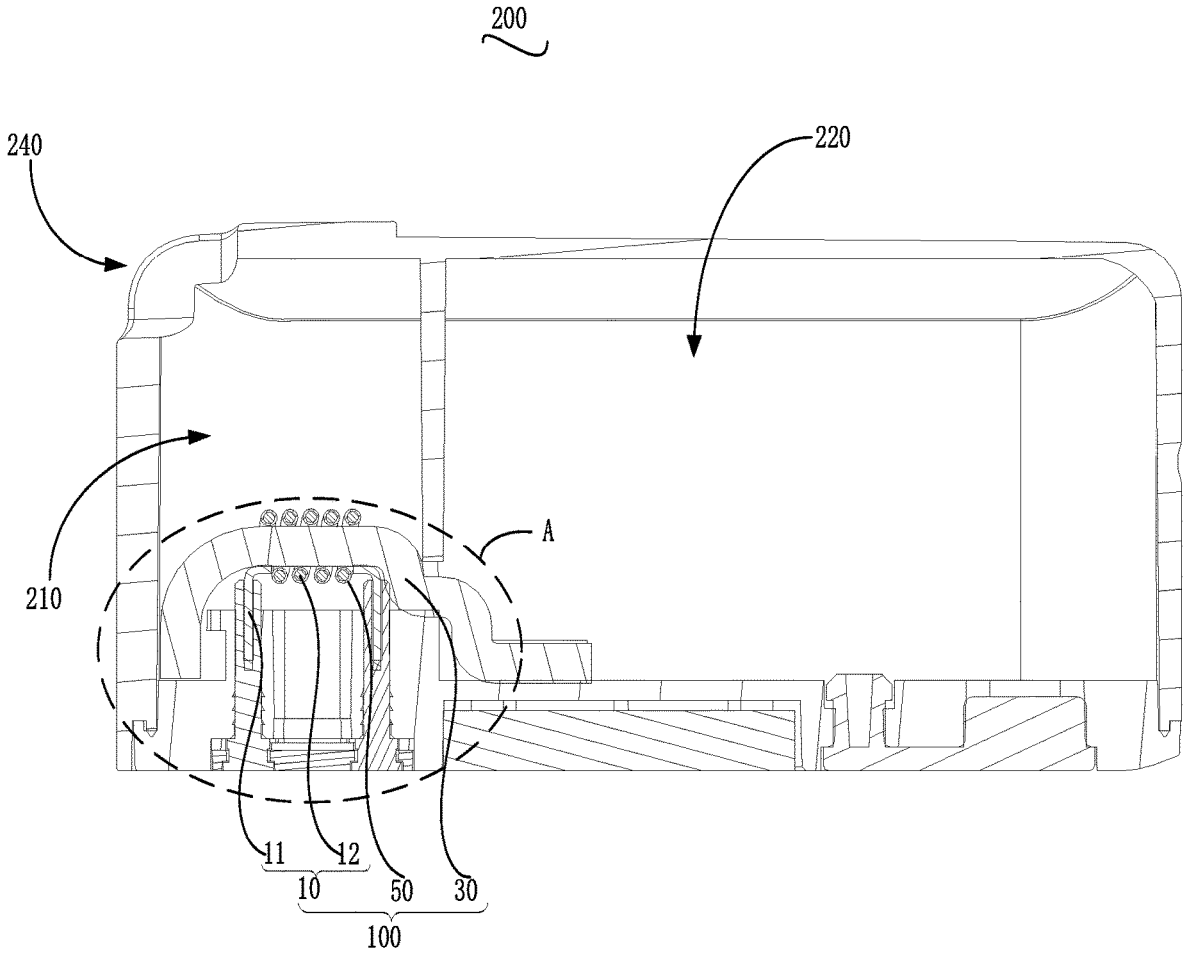
FIG. 1 is a section view of the connecting structure when the heating element is installed in the atomizer in present disclosure.

| Reference Number | Name of Part | Reference Number | Name of Part |
|---|---|---|---|
| 100 | Heating element | 50 | Solid-state protective layer |
| 10 | Heater | 200 | Atomizer |
| 11 | Connector | 210 | Atomizing chamber |
| 12 | Atomizing component | 220 | Liquid storing chamber |
| 121 | Smoke passage | 230 | Air inlet |
| 122 | Atomizing channel | 240 | Suction hole |
| 30 | Liquid absorbent | | |

The implementation of the goals, the function features and the advantages of the present disclosure are described below in further detail in conjunction with the embodiment with reference to the drawings.

DETAILED DESCRIPTION

A clear and complete description as below is provided for the technical scheme in the embodiment of the present disclosure in conjunction with the drawings as follows. The embodiment described hereinafter, however, obviously represent some of the possible embodiment of the present disclosure, rather than all the possible embodiment. Any other embodiment obtained by the ordinary skilled persons in this field based on the structure of the following drawings without any creative work are intended to be included in the scope of protection of the present disclosure.

It should be noted that all directional indications (e.g., top, bottom, left, right, front, behind, etc.) in the embodiment of the present disclosure are merely to illustrate the relative position and the relative motion condition among each component in a particular state (as shown in the drawings). If the particular state changes, the directional indication shall change accordingly.

In addition, any terms referencing "first" and "second" in the present disclosure are intended to describe the matters, and are not indicative of, expressly or implicitly, the relative importance or the quantity of the designated technical features of those descriptions. Thus, any features that have "first" or "second" references may specifically or implicitly include at least one such feature. Moreover, technical schemes of each embodiment of the present disclosure can be combined mutually; however, it must be carried out on the condition that the ordinary skilled person in this field can implement the combination. To the extent that the technical schemes have a conflict to each other or cannot be implemented, such combination of the technical schemes shall be considered as not existent and thus are not intended to be included in the scope of protection of the present disclosure.

In the present disclosure, unless expressly defined and limited otherwise, terms such as "connect" and "fixed" shall be broadly construed. For example, "fixed" may mean a fixed connection, or a disposable connection, or as a whole; it may also mean mechanical connection, or electronic connection; it may mean direct connection, or indirect connection with media in between; it may mean inner connection between two components, or the interaction between the two components, unless expressly defined otherwise. An ordinary skilled person in this field may construe the particular meaning of each of such terms based on the specific descriptions in the present disclosure.

The present disclosure provides an electronic cigarette, which comprises an atomizer 200 and a power supply component (not shown in the drawing) providing power for the atomizer 200. The atomizer 200 comprises a liquid storing chamber 220 for e-liquid refilling, a heating element 100, an atomizing chamber 210, and an atomizing channel 122 that communicates with the atomizing chamber 210. The heating element 100 is accommodated in the atomizing chamber 210. Outside the atomizer 200, the atomizing channel 122 forms an air inlet 230 (not shown in the drawing) and a suction hole 240. The heating element 100 heats the e-liquid absorbed from the liquid storing chamber 220 under current drive so as to generate smoke which is drained out from the atomizing channel 122 and inhaled by users.

Figure 2:
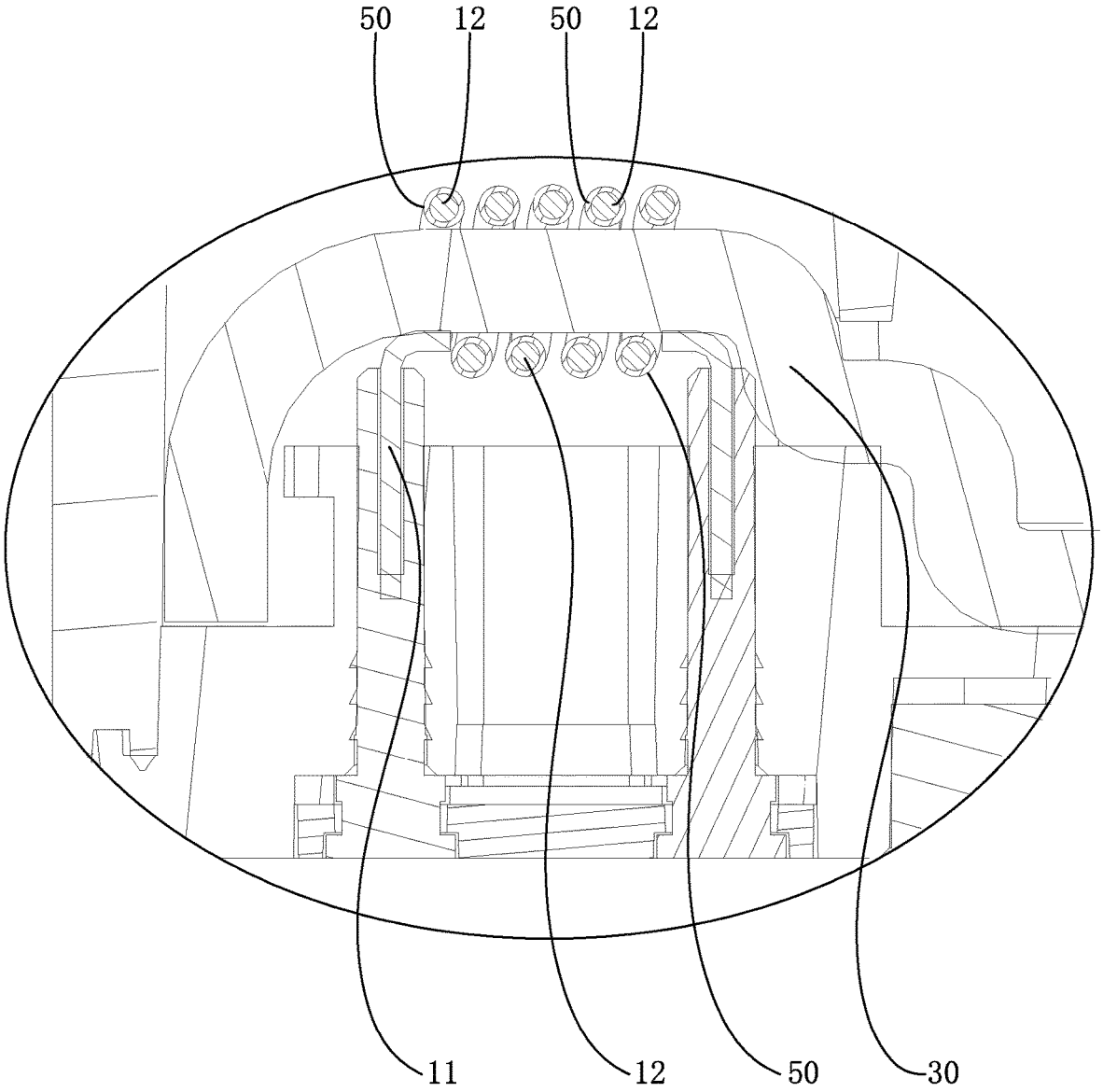
FIG. 2 is a partially exploded view of the Part A in FIG. 1.
Figure 3:
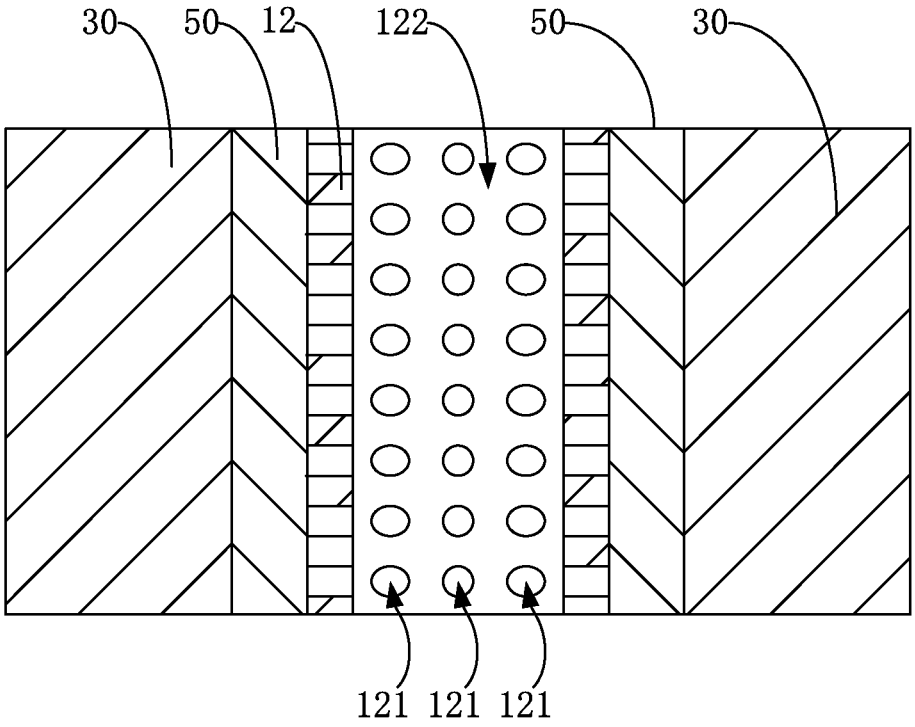
FIG. 3 is a sectional view of the connecting structure between the hollow tube of the atomizing component and the liquid absorbent in the present disclosure.

Referring to FIG. 1 to FIG. 3, the heating element 100 comprises a heater 10, a liquid absorbent 30, and a solid-state protective layer 50. When the heating element 100 is installed in the atomizer 200, a part of the liquid absorbent 30 is accommodated in the liquid storing chamber 220 and the other part of the liquid absorbent 30 is accommodated in the atomizer 200 so that it can absorb the e-liquid refilled in the liquid storing chamber 220 into the atomizing chamber 210. Additionally, a part of the heater 10 is accommodated in the atomizing chamber 210 and in contact with the liquid absorbent 30. In some implementations, the solid-state protective layer 50 is placed between the heater 10 and the liquid absorbent 30. In operation, the heater 10 heats the solid-state protective layer 50 under current drive so that the solid-state protective layer 50 be melted and absorbed by the liquid absorbent 30. In the present embodiment, the solid-state protective layer 50 is made of solid glycerin, solid propylene glycol, or solid e-liquid.

In the heating element 100 of the present disclosure, by providing a solid-state protective layer 50 between the heater 10 and the liquid absorbent 30, the heater 10 heats and melt the solid-state protective layer 50 under current drive. The melted solid-state protective layer 50 can then be absorbed by the liquid absorbent 30. The liquid absorbent 30 can then contact the heater 10 for vaporization which effectively prevents the dry burning of the liquid absorbent 30 by the heater when the atomizer is not refilled with e-liquid during the first use.

In the exemplary embodiment, as illustrated in FIG. 1 and FIG. 2, the solid-state protective layer 50 covers the surface of the heater 10. In addition, the solid-state protective layer 50 covers the surface of the heater 10 so that the heater 10 will first heat the solid-state protective layer 50 that is in contact with the heater and melt the solid-state protective layer 50 so that the liquid absorbent 30 can absorb the melting e-liquid to effectively prevent the dry burning of the liquid absorbent 30.

In the exemplary embodiment, as illustrated in FIG. 1 and FIG. 2, the heater 10 comprises a connector 11 and an atomizing component 12 that is in contact with the liquid absorbent 30. The connector 11 is used to be electrically contacted with the atomizer 200, and the atomizing component 12 is used to heat the e-liquid absorbed by the liquid absorbent 30 under current drive, with the solid-state protective layer 50 covering at least the surface of the atomizing component. In the example embodiment, the surface of the heater 10 directly contacting with the liquid absorbent 30 forms the atomizing component 12, and the atomizing component 12 is used to heat and atomize the liquid absorbent 30. Therefore, by covering the surface of atomizing component 12 with the solid-state protective layer 50, the solid-state protective layer 50 will be melted when the heater 10 is heated. In some implementations, the melted solid-state protective layer 50 will be directly absorbed by the liquid absorbent 30 because of the contacting of the atomizing component 12 with the liquid absorbent 30. In some implementations, the connector 11 is not covered by the solid-state protective layer 50 to prevent potential damage to other parts of the atomizing chamber 210 caused by the condensation of the melted solid-state protective layer 50. For example, when the melted solid-state protective layer 50 cannot be fully absorbed by the liquid absorbent 30, the melted solid-state protective layer 50 could drip down to other parts of the atomizing chamber 210. Thus, if the connector 11 is covered by the solid-state protective layer 50 potential damage may be prevented.

In the exemplary embodiment, as illustrated in FIG. 1 or FIG. 2, the atomizing component 12 has a spiral shape, and winds on the surface of the liquid absorbent 30. In addition, in the present embodiment, because of that the atomizing component 12 has a spiral shape and winds on the liquid absorbent 30, there is a maximized contacting surface of atomizing component 12 with the liquid absorbent 30. A maximized contacting surface will increase the absorbing efficiency of the liquid absorbent 30 in order to increase the absorbing of the melted solid-state protective layer 50 by the liquid absorbent 30, and thus to avoid the dry burning of the liquid absorbent 30.

In the exemplary embodiment, as illustrated in FIG. 3, the atomizing component 12 is set as a hollow tube, and its external surface is covered by the solid-state protective layer 50. The liquid absorbent 30 covers the surface of the solid-state protective layer 50. The hollow part of the heater 10 defines an atomizing channel 122 for smoke to pass through. Here, in this embodiment, the atomizing component 12 is set as a hollow tube, and the outer surface of the atomizing component 12 is covered by the solid-state protective layer 50. The liquid absorbent 30 covers the solid-state protective layer 50, and the outer surface of the liquid absorbent 30 is in direct contact with the inner wall of atomizing chamber 210. The inner wall of atomizing chamber 210 defines an oil-guiding hole communicated with the liquid storing chamber 220. Thus, the solid-state protective layer 50, once melted, will directly be absorbed by the liquid absorbent 30 instead of dripping down to other parts of the atomizer. Additionally, the outer surface and inner surface of the liquid absorbent 30 can simultaneously absorb e-liquid, which increases the absorbing efficiency of such liquid absorbent 30 and thus prevents the dry-burning. Also, the tube is formed by the wrapping of the heater 10, or it can be formed as a web shape. Otherwise, the tube is provided with smoke passage 121 communicating with the liquid absorbent 30. The hollow part of the tube then defines an atomizing channel 122 so that the air can pass through. In that way, when the users are inhaling through the mouthpiece of the electronic cigarette, the heater 10 will directly contact liquid absorbent 30 and then generate smoke, which then flow into the atomizing channel 122 for the users to inhale.

It should be understood that the embodiment of covering the heater 10 with the solid-state protective layer 50 is not the only embodiment to implement the present disclosure. For example, in another embodiment, the solid-state protective layer 50 can also cover the surface of liquid embodiment 30. When the heater 10 produces heat, the solid-state protective layer 50 that covers the liquid absorbent 30's surface is melted and then is absorbed. The former embodiment also falls into the scope of the present disclosure.

Further, the liquid absorbent 30 is fully drenched in the solid-state protective layer so that the entire liquid absorbent 30 will be evenly covered by the solid-state protective layer 50, which will effectively prevent the uneven absorbing of the liquid absorbent 30 or glitches of the liquid absorbent 30 which may lead to dry-burning if in direct contact with the heater 10. Additionally, compared to the traditional absorbent cotton, the liquid absorbent 30 is firmer as the liquid absorbent 30's surface (or its entire body) is covered by the solid-state protective layer 50, which eases the installation of the liquid absorbent 30.

In some implementations, the heater 10 is made from one of nickel, titanium, tungsten, gold, silver, or stainless steel. In the exemplary embodiment, the heater 10 is made of stainless steel, which is easier for shaping and has a faster heating speed, which can melt the solid-state protective layer 50 in a relatively shorter period and thus further prevents the dry burning of the liquid absorbent.

In some implementations, the liquid absorbent 30 is made from one of glass fiber thread, absorbent cotton, or organic cotton. In the exemplary embodiment, the liquid absorbent 30 is made of organic cotton, which is finer than the absorbent cotton fiber, is more voluminous, softer, and is less prone to residual odors. In addition, the liquid absorbent 30 e-liquid absorption is faster and larger, more resistant to higher temperatures, and has better reducibility for the e-liquid flavors during evaporation.

In some implementations, an atomizer 200 comprises a heating element 100. The heating element has a detail structure illustrated as above. Because atomizer 200 employs all the technical schemes in the above embodiment, and thus it holds all the strengths and beneficial effects brought by the technical schemes of the above embodiment. No further description is needed here.

In some implementations, an electronic cigarette comprises the atomizer 200 described above. Because the electronic cigarette employs all the technical schemes in the above embodiment, and thus it holds all the strengths and beneficial effects brought by the technical schemes of the above embodiment. No further description is needed here.

The above embodiments are only the preferred embodiment of the present disclosure and are not intended to limit the patent scope of the present disclosure. Any equivalent structures made according to the description and the accompanying drawings of the present disclosure without departing from the idea of the present disclosure, or any equivalent structures applied in other relevant technical fields, directly or indirectly, are intended to be included in the scope of the protection of the present disclosure.

What is claimed is:

1. A heating element for an atomizer of an electronic cigarette, the atomizer defining an atomizing chamber and a liquid storing chamber for e-liquid refilling, the heating element comprising:

a heater;

a liquid absorbent; and a solid-state protective layer placed between the heater and the liquid absorbent, wherein the heater is configured to heat and melt the solid-state protective layer such that the solid-state protective layer is absorbed by the liquid absorbent under current drive.

2. The heating element of claim 1, wherein the solid-state protective layer covers a surface of the heater.

3. The heating element of claim 1, wherein the heater comprises:

a connector configured to electrically connect with the atomizer; and an atomizing component contacting the liquid absorbent and configured to heat the e-liquid absorbed by the liquid absorbent under current drive, wherein the solid-state protective layer covers at least a surface of the atomizing component.

4. The heating element of claim 3, wherein the atomizing component has a spiral shape and winds on a surface of the liquid absorbent.

5. The heating element of claim 3, wherein:

the atomizing component is set as a hollow tube;

the solid-state protective layer is provided on an outer surface of the atomizing component;

the liquid absorbent covers the surface of the solid-state protective layer; and a hollow part of the heater defines an atomizing channel for smoke to pass through.

6. The heating element of claim 1, wherein the solid-state protective layer covers a surface of the liquid absorbent.

7. The heating element of claim 1, wherein at least a portion of the heater is made of nickel, titanium, tungsten, gold, silver, or stainless steel.

8. The heating element of claim 1, wherein at least a portion of the liquid absorbent is made of glass fiber thread, absorbent cotton, or organic cotton.

9. An atomizer comprising:

a heating element, wherein the heating element comprises:

a heater;

a liquid absorbent; and a solid-state protective layer placed between the heater and the liquid absorbent, wherein the heater is configured to heat and melt the solid-state protective layer such that the solid-state protective layer is absorbed by the liquid absorbent under a current drive, wherein the atomizer defines an atomizing chamber and a liquid storing chamber for e-liquid refilling.

10. The atomizer of claim 9, wherein the solid-state protective layer covers a surface of the heater.

11. The atomizer of claim 9, wherein the heater comprises:

a connector configured to electrically connect with the atomizer; and an atomizing component contacting the liquid absorbent and configured to heat the e-liquid absorbed by the liquid absorbent under current drive, wherein the solid-state protective layer covers at least a surface of the atomizing component.

12. The atomizer of claim 11, wherein the atomizing component has a spiral shape and winds on a surface of the liquid absorbent.

13. The atomizer of claim 11, wherein:

the atomizing component is set as a hollow tube;

the solid-state protective layer is provided on an outer surface of the atomizing component;

the liquid absorbent covers the surface of the solid-state protective layer; and a hollow part of the heater defines an atomizing channel for smoke to pass through.

14. The atomizer of claim 9, wherein the solid-state protective layer covers a surface of the liquid absorbent.

15. The atomizer of claim 9, wherein at least a portion of the heater is made of nickel, titanium, tungsten, gold, silver, or stainless steel.

16. The atomizer of claim 9, wherein at least a portion of the liquid absorbent is made of glass fiber thread, absorbent cotton, or organic cotton.

17. An electronic cigarette comprising:

an atomizer defining an atomizing chamber and a liquid storing chamber for e-liquid refilling, the atomizer comprising a heating element, wherein the heating element comprises:

a heater;

a liquid absorbent; and a solid-state protective layer placed between the heater and the liquid absorbent, wherein the heater is configured to heat and melt the solid-state protective layer such that the solid-state protective layer is absorbed by the liquid absorbent under a current drive.

18. The electronic cigarette of claim 17, wherein the solid-state protective layer covers a surface of the heater.

19. The electronic cigarette of claim 17, wherein the heater comprises:

a connector configured to electrically connect with the atomizer; and an atomizing component contacting the liquid absorbent and configured to heat the e-liquid absorbed by the liquid absorbent under current drive, wherein the solid-state protective layer covers at least a surface of the atomizing component.

20. The electronic cigarette of claim 19, wherein:

the atomizing component is set as a hollow tube;

the solid-state protective layer is provided on an outer surface of the atomizing component;

the liquid absorbent covers the surface of the solid-state protective layer; and a hollow part of the heater defines an atomizing channel for smoke to pass through.

* * * * *